United States Patent [19]

Ege

[11] 4,280,016

[45] Jul. 21, 1981

[54] FIRE RESISTANT ELECTRIC CABLE

[75] Inventor: Sigmund Ege, Oslo, Norway

[73] Assignee: International Standard Electric Corporation, New York, N.Y.

[21] Appl. No.: 68,096

[22] Filed: Aug. 20, 1979

Related U.S. Application Data

[63] Continuation of Ser. No. 898,823, Apr. 21, 1978, abandoned.

[51] Int. Cl.[3] ..... H01B 7/24

[52] U.S. Cl. ..... 174/102 R; 174/128 R; 174/130

[58] Field of Search ..... 174/102 R, 69, 106 D, 174/128 R, 126 CS, 130

[56] References Cited

U.S. PATENT DOCUMENTS

| | | | |
|---|---|---|---|
| 1,782,812 | 11/1930 | Dibner | 174/128 R |
| 2,061,862 | 11/1936 | Wells | 174/119 R |
| 3,015,686 | 1/1962 | Heckel | 174/119 R |
| 3,180,925 | 4/1965 | Ege | 174/102 R |
| 3,324,233 | 6/1967 | Bryant | 174/130 X |
| 3,553,350 | 1/1971 | Rawlins | 174/130 |

FOREIGN PATENT DOCUMENTS

| | | | |
|---|---|---|---|
| 817312 | 8/1951 | Fed. Rep. of Germany | 174/128 R |

*Primary Examiner*—Richard R. Kucia
*Attorney, Agent, or Firm*—William T. O'Neil

[57] ABSTRACT

A multiwire conductor in which a layer of wires surrounds a center wire. The center wire has a predesigned structure which produces many small, negligible kinks instead of few intolerable ones, which may otherwise occur as the result of temperature changes or stress variations.

5 Claims, 11 Drawing Figures

22
22
23
22
20
21
d D

21a

21b 24
21c
25

24
c
25

24
21e
24
A
B 22d
21d
20d 25
21f 21e
22
26

22
27
21b 29
28
31
30

FIRE RESISTANT ELECTRIC CABLE

CROSS-REFERENCE TO RELATED APPLICATION

This application is a continuation of U.S. patent application Ser. No. 898,823, filed Apr. 21, 1978 now abandoned.

BACKGROUND OF THE INVENTION

This invention relates to a multiwire conductor and, in particular, to a multiwire conductor comprising at least one center wire laid substantially parallel to the axis of the conductor with one or more layers of wires stranded around it in a normal manner.

One form of such a conductor is disclosed in my prior U.S. Pat. No. 3,180,925.

The object of this invention is to provide a multiwire conductor particularly suited for use in electric cables, which are expected to maintain circuit integrity under high temperature conditions, and in electric strain cables.

A cable having an insulation which, when it is subjected to very high temperatures or even flames, is transformed into an electrically insulating ash, may maintain its working capacity during and after a fire. An assumption is then that the insulating ash is kept safe in position within the cable, and also that the cable is fastened securely to constructions being stable during the fire to avoid bending and mechanical stress of the cable.

Even when all such assumptions are fulfilled, known cables have evidenced a high percentage of failures during flame tests. To understand the background of such failures, it is necessary to consider the design of a conventional cable within this art.

A conventional stranded multiwire conductor comprises at least seven copper wires of equal diameters with six of the wires stranded helically and evenly around the seventh wire, which is centrally arranged in the multiwire conductor. The center wire is straight and linear.

The known multiwire conductor is usually insulated with an inorganic insulation or an insulation comprising a large inorganic component. To maintain the insulation securely around the conductor, each insulated multiwire conductor is covered by a glass braid. Over the glass braid a metallic shield may be applied, such as one consisting of a copper braid. It is further known to use silicone rubber as conductor insulation and to cure the silicone rubber at elevated temperatures before applying the glass braid.

From the above-mentioned U.S. Pat. No. 3,180,925, it is further known to envelop the insulated multiwire conductor in a glass braid and to use molybdenum in the center wire in the multiwire conductor. A cable may comprise several individually insulated multiwire conductors in a common metallic shield.

When using a design according to said U.S. Patent, it has been found that failures do not occur. However, it is not an ideal solution to use one conductor of molybdenum in such a multiwire conductor. On the one hand, molybdenum is a rather expensive material, and on the other hand, there is a desire that all the wires should be made of the same material, as this will simplify jointing in the field.

One theory of how the failures occur when a conventional cable, not including a molybdenum center wire, is subjected to a flame test is stated below.

When the insulation, as e.g. silicone rubber, is burnt into ashes, the insulation diameter tends to increase slightly. The braid of glass, which is applied around the core, then is radially extended, and this again results in a longitudinal contraction of the braid. As this longitudinal contraction occurs simultaneously with the radial expansion, the frictional forces between the burnt insulation and the multiwire conductor elements become very large. Therefore, the longitudinal contraction of the braid will be frictionally transferred to the helical, outer elements of the multiwire conductor and further to the center wire. Because of the helical form, the outer elements of the multiwire conductor are free to contract in the longitudinal direction. The center wire, on the other hand, in a conventional multiwire conductor, is a straight element, and an even contraction in longitudinal direction beyond the elasticity limit is impossible. Instead, there will be built up a longitudinal, compression force until the center wire kinks in an uncontrolled manner. The other elements of the multiwire conductor will then also be forced out in a kink and may, if a large kink occurs, make contact with the outer metal braid, which finally results in a short.

The object of the present invention is to eliminate the risk of kinks forming in the conductors of cables which have the ability to stay serviceable (without shorting) even after burning. The same design may also be used to prevent kinks in the conductors of so-called strain cables (cables which are designed to withstand high tension). The conductors of such cables have been known to form kinks when the high tension is removed, much in the same manner as described above, only that the compressive force causing the kinks to form is a result of the cable "snapping back" due to its elasticity.

It is well known that the risk of forming kinks in the conductors of a strain cable is reduced by using, for instance, a plastic monofilament instead of the center wire in a seven wire conductor. A similar result will be achieved according to the present invention without resorting to a different material in the center of the conductor by arranging or preparing the center wire in a manner to be described later herein. When jointing is considered, it is advantageous to have the same material in all the wires of the multiwire conductor.

When a multiwire-conductor having a molybdenum center wire works properly, this may be a result of the fact that the molybdenum has a temperature coefficient which differs from that of copper.

The object of the present invention, therefore, is to achieve a multiwire conductor which neither exhibits large kinks when subjected to flame tests, nor when used in a strain cable, and where all the elements of the multiwire conductor consist of the same metallic material to simplify the jointing procedures.

It is not certain that the simple theory stated above represents a complete view of this problem, but experiments have at least proved that a cable according to the present invention endures flame tests without any failures.

SUMMARY OF THE INVENTION

According to the principal aspect of the invention, there is provided a multiwire conductor in which the center wire has a configuration such that when the center wire is subjected to compressive forces, it will tend to produce a predetermined, controlled number of negligibly small kinks.

When a center wire according to this invention is subjected to compressive forces, it will tend to kink radially at a number of predetermined points instead of being compressed longitudinally. Thus, longitudinal, compressive forces will not build up sufficiently to produce large kinks. Two main alternatives are shown for obtaining this result.

The center wire may, according to the first alternative, be preformed in such a manner that it is no longer straight. When a longitudinal compressive force is applied, such a wire will produce small, radially extending kinks at predetermined places. If thus the center wire is preformed into a sine curve, the axial, compressive forces will increase the amplitude of the sine curve, the axial, compressive forces will increase the amplitude of the sine curve and decrease the period of the same. Thus, the kinks already introduced when shaping the center wire into a sine curve, will only be enlarged when axial compression takes place. In this example and also when the center wire is preformed to a helix, the number of kinks introduced are infinite, but each kink will also be infinitesimally small. Said in other words, the kinks will be represented by an evenly distributed bending operation.

If the center wire is formed into a zig-zag shape, the number of kinks will also be predetermined. And in each case, the kinks will be controlled, as each kink will not exceed the dimensions of the tube built up from the outer wires. Instead of developing large kinks, several new, small kinks will develop.

Another method of solving this problem is to use a straight center wire but introducing therein some weak spots, at which kinking will occur when the center wire is subjected to compressive forces. Thus, a straight wire having staggered rows of weak spots will kink into a zig-zag shape as soon as compressive forces are acting on it. This condition is further improved by selecting a diameter for the center wire which is slightly smaller than that of the outer wires.

DESCRIPTION OF THE PREFERRED EMBODIMENTS

Figures 1, 2, 3, 4, 5, 6, 7, 8, 9, 10, 11:
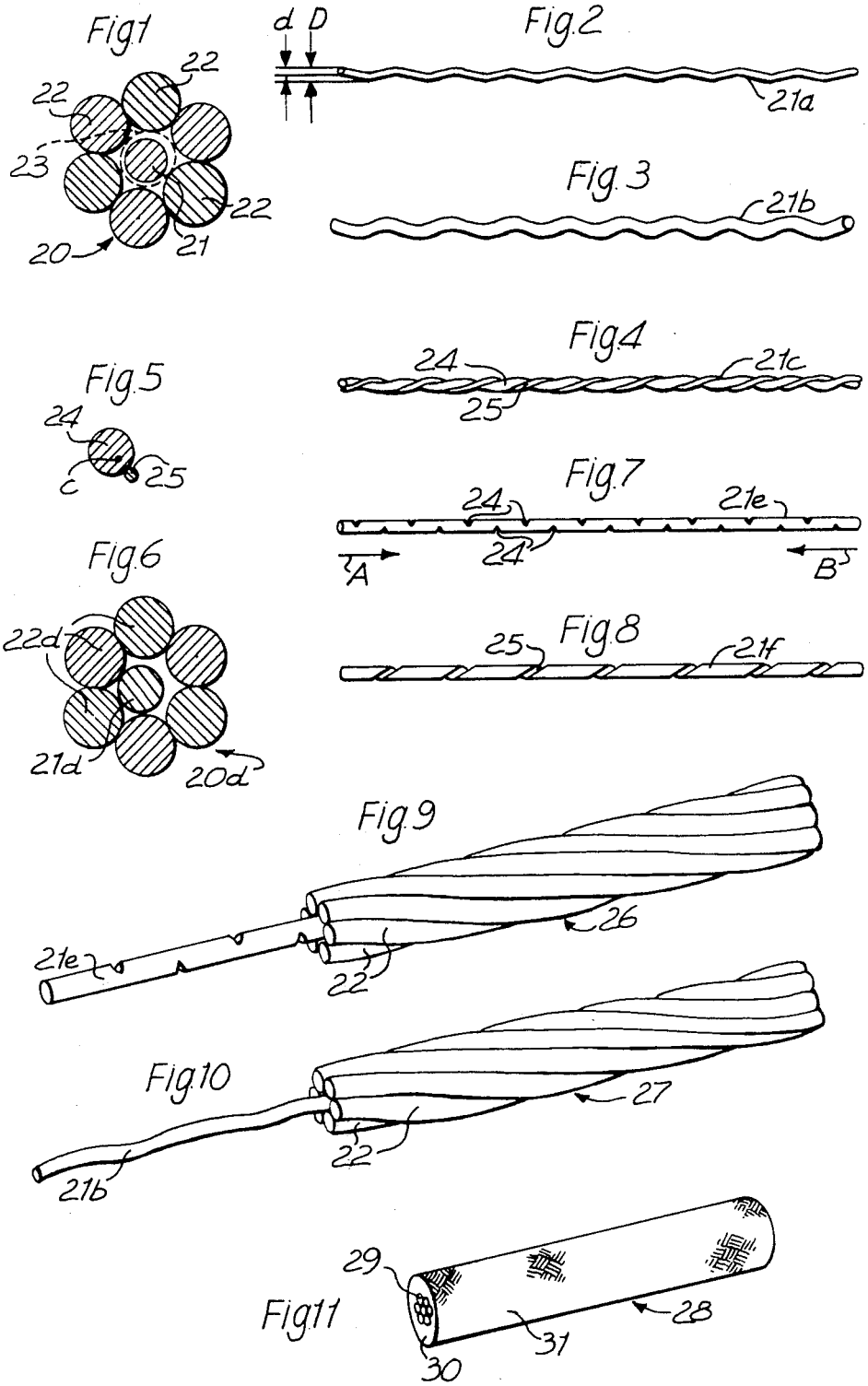
FIG. 1 is a cross-sectional view of a multiwire conductor according to the present invention.
FIGS. 2, 3 and 4 illustrate in side elevation three different types of center conductors according to the present invention.
FIG. 5 is a cross-sectional view of the center conductor shown in FIG. 4.
FIG. 6 is a cross-sectional view of a multiwire conductor according to still another embodiment of the invention.
FIGS. 7 and 8 are side elevational views of two embodiments of a center conductor according to two further embodiments of the invention.
FIGS. 9 and 10 are perspective views showing two different embodiments of a multiwire conductor according to the present invention.
FIG. 11 is a perspective view of a cable, incorporating a multiwire conductor according to the present invention.

In FIG. 1 a preferred embodiment of a multiwire conductor 20 according to the present invention is shown in cross-sectional form. The center conductor 21 has a slightly smaller diameter than that of the six surrounding conductors 22. When such a multiwire conductor is stranded, the surrounding conductors will thus form a self-bearing, oversize tube (shown in dotted lines at 23) within which the center conductor is loosely arranged. In the figure, the differences in diameters of the conductors are exaggerated to make the drawing clearer. The number of conductors 22 in the surrounding layer may of course differ from six, which however represents the most conventional design.

As the surrounding conductors form an oversize tube, various possibilities of preforming the center conductor within the limits of this tube are available.

In FIG. 2 a center conductor **21*a* having a zig-zag form is shown. The diameter of the center conductor is d, while the largest diameter D of the zig-zag form should be equal to or smaller than the diameter of each of the surrounding conductors 22. Different zig-zag forms are also available. Thus, the zig-zag bends of the center conductor may all be in one plane or in different planes. The zig-zag form may also be similar to a helix, as each straight member of the conductor is tangential to an enveloped helix. All types of preshaping may be undertaken within the limits of the dimensions of the tube 23**.

In FIG. 3, there is shown a center conductor **21*b*** having a sine shape. The same conditions as mentioned above also apply to this sine shape. Thus, two different sine waves laying in different planes may be superimposed. The center conductor may also have the shape of a helix. Then all projections of such a helix will be a sine curve.

Still a further embodiment of the center conductor is shown in FIGS. 4 and 5. Here the center conductor **21*c* consists of two wires 24 and 25. As shown, the wires 24 and 25** have different diameters. However, the diameters may be equal, and the number of wires in the center conductor may be more than two. Thus, even a plurality of equal, stranded wires making up a center wire are within the scope of this invention.

From FIG. 5, it is understood that the axis of the heavier wire 24, due to the stranding, shall not fall exactly along the center wire axis C but will form a small helix around the center axis. Because of this fact, each single element in the center wire will, with this design and when compressive forces are acting thereon, undergo a substantial, even deformation instead of building up stress until a large kink occurs.

As seen in FIG. 6, it is also possible to start with a straight center conductor **21*d* which may be deformed into a small helix during the stranding operation to produce a multiwire conductor 20*d*. By letting one or some of the conductors 22*d*** of the outer layer have a smaller diameter than the remaining conductor in this layer, the stranding process of the center conductor will automatically produce a cross-section in which no conductor will run exactly axially. This solution has the advantage that no conductor has to be preformed.

Still another principle of solution to the kinking problem is available. Two different embodiments, both based on this principle, are shown in FIGS. 7 and 8. The principle is that the center conductor is running straight and exactly axially through the multiwire conductor but that weak spots are introduced in the surface of the center conductor so that small kinks will develop on predetermined places along the center conductor when it is subjected to compressive forces.

In FIG. 7, the weak spots in the surface of the center conductor 21*e* are two, oppositely arranged and staggered rows of small recesses or indentations 24.

When such conductor is subjected to compressive forces as indicated by the arrows A and B in FIG. 7 and at the same time is supported by a surrounding tube (formed by the outer conductors not shown in this figure), small kinks will be produced until the center conductor has obtained a zig-zag configuration.

In FIG. 8, the indentations or recesses are made up by one continuously running groove 25, helically applied to the center conductor. When a compressive force is introduced, this will result in a helical deformation of the center conductor.

FIGS. 7 and 8 only represent two examples of this principle. The weak spots may be arranged in many different manners within the scope of the present invention. The only important restriction is that the recesses or indentations must not all be arranged on the same side of the center conductor. In other words, two adjacent indentations should not be situated exactly on the same generatrix of the conductor.

The required preforming of the center conductor may be obtained in many different ways. One method is to pass the center conductor through preforming rollers in tandem with the stranding operation. A similar technique may be used when indentations are desired.

FIG. 9 shows a multiwire conductor 26 having a center conductor 21*e* according to FIG. 7.

FIG. 10 shows a multiwire conductor 27 having a center conductor 21*b* according to FIG. 3.

FIG. 11 shows finally a signal cable 28 incorporating a multiwire conductor 29 according to any one of the embodiments of the present invention, covered by an insulation layer 30 and an outer copper braiding 31.

Although the present invention has been described in detail, this description only refers to specific embodiments, and the invention may be varied and modified in many different ways without departing from the scope of this invention as defined by the appended claims. For instance, the number of conductors surrounding the center conductor may be more than six, and they may be arranged in more than one layer of outer conductor elements. Further, the multiwire conductor according to this invention may be used to build up a flame-proof cable or a strain cable comprising one or more such multiwire conductors.

What is claimed is:

1. A fire damage resistant, electric cable comprising:

a layer of wires stranded about the perimeter of a central circle forming an interior longitudinally extending space having a center axis;

a layer of electrical insulating material surrounding said layer of wires and a jacket of conductive material over said insulating material;

a solid, straight center wire placed within said longitudinally extending space, said center wire having an average diameter over its length which is less than that of said central circle, said center wire having regularly spaced weak spots such that when said center wire is subjected to compressive forces, small distributed deformations will take place at each of said weak spots so that no large kink will occur in said center wire.

2. An electric cable as set forth in claim 1 wherein:

said weak spots are indentations regularly spaced along the conductor length.

3. An electric cable as set forth in claim 2 wherein:

said indentations are angularly and longitudinally staggered on said center conductor.

4. An electric cable as set forth in claim 2 wherein:

said indentations are arranged in opposite and staggered rows, either perpendicular to or oblique to said center axis.

5. An electric cable as set forth in claim 2 wherein:

said weak spots are provided by a continuous, helically shaped surface groove in said center conductor.

* * * * *

UNITED STATES PATENT OFFICE

CERTIFICATE OF CORRECTION

PATENT NO. : 4,280,016

DATED : July 21, 1981

INVENTOR(S) : Sigmund Ege

It is certified that error appears in the above-identified patent and that said Letters Patent are hereby corrected as shown below:

On the title page:

[30] Foreign Application Priority Data

May 5, 1977 Norway ... 771581

Signed and Sealed this

Nineteenth Day of April 1983

[SEAL]

Attest:

GERALD J. MOSSINGHOFF

Attesting Officer

Commissioner of Patents and Trademarks